US010199763B2

(12) United States Patent
Zhu et al.

(10) Patent No.: US 10,199,763 B2
(45) Date of Patent: Feb. 5, 2019

(54) ELECTRICAL CONNECTOR HAVING EXCELLENT WATERPROOF PROPERTY

(71) Applicant: FOXCONN INTERCONNECT TECHNOLOGY LIMITED, Grand Cayman (KY)

(72) Inventors: Zhi-Hui Zhu, Kunshan (CN); Da-Wei Zhang, Kunshan (CN); Shu-Jian Wang, Kunshan (CN); Yen-Chih Chang, New Taipei (TW); Ming-Guang Bai, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/588,704

(22) Filed: May 8, 2017

(65) Prior Publication Data

US 2017/0324187 A1 Nov. 9, 2017

(30) Foreign Application Priority Data

May 6, 2016 (CN) ..... 2016 2 0403507 U

(51) Int. Cl.
*H01R 13/648* (2006.01)
*H01R 13/52* (2006.01)
(Continued)

(52) U.S. Cl.
CPC ..... *H01R 13/5202* (2013.01); *H01R 13/521* (2013.01); *H01R 13/5213* (2013.01); *H01R 13/6594* (2013.01); *H01R 43/005* (2013.01)

(58) Field of Classification Search
CPC ..... H01R 12/57; H01R 13/5219; H01R 13/5202; H01R 23/6873; H01R 13/65802; H01R 23/7073
(Continued)

(56) References Cited

U.S. PATENT DOCUMENTS 7,922,535 B1 * 4/2011 Jiang ..... H01R 13/5205 439/271
8,083,549 B1 * 12/2011 Chiang ..... H01R 43/24 439/607.55
(Continued)

FOREIGN PATENT DOCUMENTS

CN 203521730 4/2014
CN 203800282 8/2014

*Primary Examiner* — Thanh Tam Le
(74) *Attorney, Agent, or Firm* — Wei Te Chung; Ming Chieh Chang

(57) ABSTRACT

An electrical connector includes a terminal module and a shielding shell surrounding the terminal module. The terminal module has an insulative housing and a plurality of conductive terminals retained in the insulative housing. The shielding shell has a metallic shell and a waterproof shell insert molded on an outer side of the metallic shell. The metallic shell surrounds the insulative housing to form a mating cavity opening forwardly. The shielding shell has a sealing member disposed between the metallic shell and the waterproof shell and a retaining member disposed at a rear side of the waterproof shell. The retaining member is separate from the sealing member. The metallic shell defines an opening slot going therethrough. The sealing member covers the opening slot. The retaining member defines a mounting leg.

11 Claims, 14 Drawing Sheets

(51) Int. Cl.
*H01R 43/00* (2006.01)
*H01R 13/6594* (2011.01)

(58) Field of Classification Search
USPC ..... 439/83, 271, 272, 559, 607.35, 607.36, 439/607.37, 607.4, 660
See application file for complete search history.

(56) References Cited

U.S. PATENT DOCUMENTS

| | | | | |
|---|---|---|---|---|
| 8,348,688 | B2 * | 1/2013 | Liu | H01R 13/5219 439/271 |
| 8,662,928 | B1 * | 3/2014 | Xie | H01R 13/6594 439/607.35 |
| 8,827,742 | B2 * | 9/2014 | Wang | H01R 24/68 439/569 |
| 8,882,542 | B2 * | 11/2014 | Song | H01R 12/707 439/607.4 |
| 9,112,296 | B2 * | 8/2015 | Zhang | H01R 13/516 |
| 9,385,484 | B2 * | 7/2016 | Chen | H01R 13/6594 |
| 9,429,360 | B2 * | 8/2016 | Hsiao | F26B 3/28 |
| 9,444,177 | B2 * | 9/2016 | Tsai | H01R 13/5202 |
| 9,711,910 | B2 * | 7/2017 | Zhao | H01R 13/5202 |
| 9,735,511 | B2 * | 8/2017 | Kao | H01R 13/5202 |
| 9,742,098 | B2 * | 8/2017 | Zhao | H01R 13/5202 |
| 2015/0270661 | A1 * | 9/2015 | Kao | H01R 13/5202 439/271 |
| 2016/0104957 | A1 * | 4/2016 | Kim | H01R 13/5219 439/78 |

* cited by examiner

ELECTRICAL CONNECTOR HAVING EXCELLENT WATERPROOF PROPERTY

BACKGROUND OF THE INVENTION

1. Field of the Invention

The present invention generally relates to an electrical connector, particularly to an electrical connector with excellent waterproof property.

2. Description of Related Art

Chinese patent issued NO. CN203521730 discloses an electrical connector with waterproof property. The electrical connector has a terminal module and a shielding shell surrounding therearound. The terminal module has an insulative housing and a plurality of conductive terminals embedded therein. The shielding shell has a metallic shell surrounding the terminal module and a waterproof shell insert molded on the metallic shell. The metallic shell has four mounting legs unitarily extending outwardly and through the waterproof shell. The molding die and the process is complex due to the complex structure of the metallic shell.

Therefore, an electrical connector with excellent waterproof property is desired hereinafter.

SUMMARY OF THE INVENTION

Accordingly, an object of the present invention is to provide an electrical connector with excellent waterproof property.

In order to achieve the object set forth, an electrical connector comprises a terminal module and a shielding shell surrounding the terminal module. The terminal module has an insulative housing and a plurality of conductive terminals retained in the insulative housing. The shielding shell has a metallic shell and a waterproof shell insert molded on an outer side of the metallic shell. The metallic shell surrounds the insulative housing to form a mating cavity opening forwardly. The shielding shell has a sealing member disposed between the metallic shell and the waterproof shell and a retaining member disposed at a rear side of the waterproof shell. The retaining member is separate from the sealing member. The metallic shell defines an opening slot going therethrough. The sealing member covers the opening slot. The retaining member defines a mounting leg.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
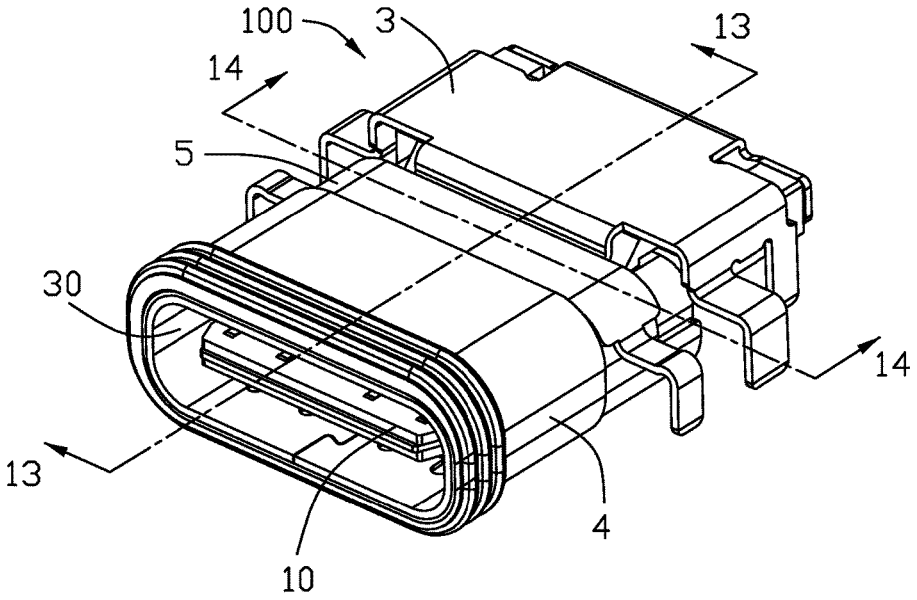
FIG. 1 is a perspective view of an electrical connector of the present invention.
Figure 2:
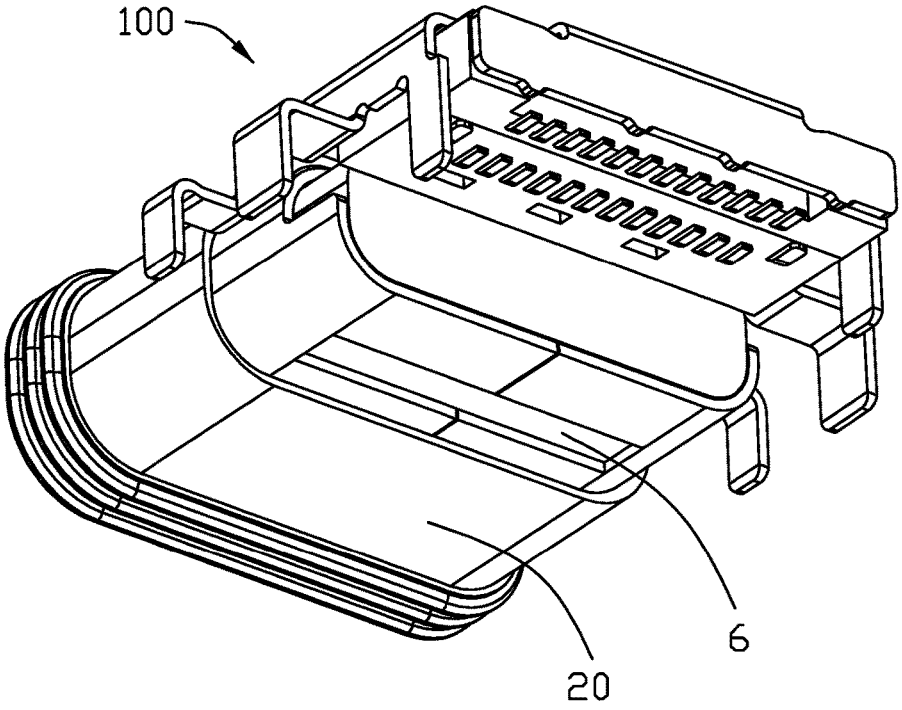
FIG. 2 is another perspective view of the electrical connector shown in FIG. 1.
Figure 3:
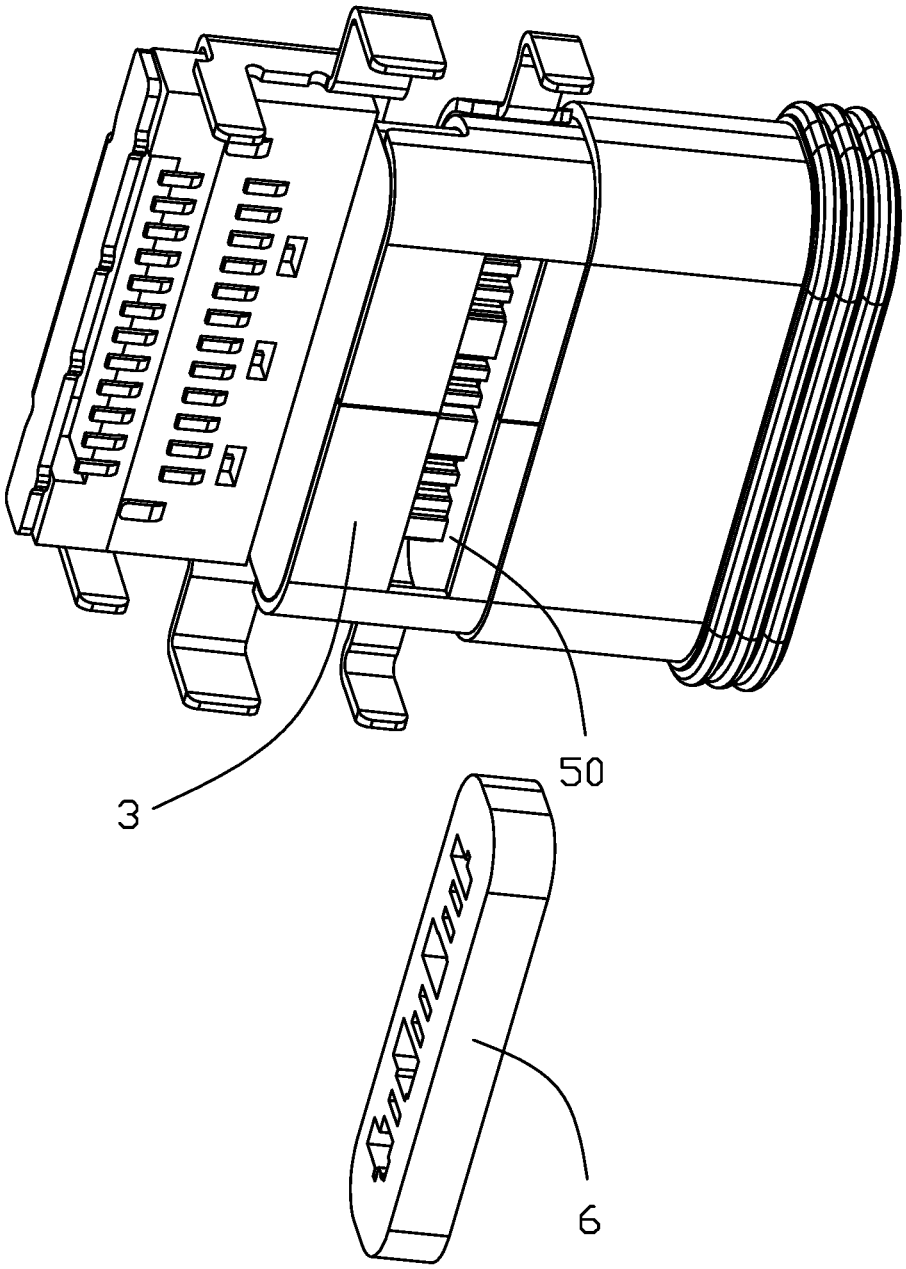
FIG. 3 is a part exploded perspective view of the electrical connector shown in FIG. 1.

Referring to FIGS. 1-3, the present invention provides an electrical connector 100 being used in an electronic device (not shown). The electrical connector 100 has a terminal module 10 and a shielding shell 20 surrounding therearound. The shielding shell 20 surrounds the terminal module 10 to form a mating cavity 30 opening forwardly. The electrical connector 100 has a waterproof member 6 disposed at a rear side of the mating cavity 30. The shielding shell 10 has an opening hole 50 for the waterproof member 6 injection therein. The waterproof member 6 is used to prevent external liquid material flowing into the electronic device from the mating cavity 30.

Referring to FIGS. 5-8, the terminal module 10 has an insulative housing 1, a plurality of conductive terminals 2 retained thereto and a metallic shielding plate 7 retained therein. The insulative housing 1 has a base portion 11 and a mating/tongue portion 12 extending forwardly therefrom. The shielding plate 7 has two opposite latching slots (not labeled) exposed to two opposite sides of the mating portion 12. The insulative housing 1 has a first housing 110 and a second housing 120. The conductive terminals 2 have a plurality of first terminals 21 and a plurality of second terminals 22. The first housing 110, the first terminals 21 and the shielding plate 7 forms a first terminal module 60 by a first insert molding process. The first housing 110 has a plurality of terminal grooves 1101. The second terminals 22 are assembled into the terminal grooves 1101 to be fixed in the first terminal module 60. Lastly, the second housing 120 is formed to surround the second terminals 22 by a second insert molding process. The first housing 110 and the second housing 120 are together to form the base portion 11 and the mating portion 12. The shielding plate 7 is disposed between the first terminals 21 and the second terminals 22. The base portion 11 forms a slot 113 extending in a transverse direction to expose the corresponding first conductive terminals 21 in the vertical direction.

Figure 13:
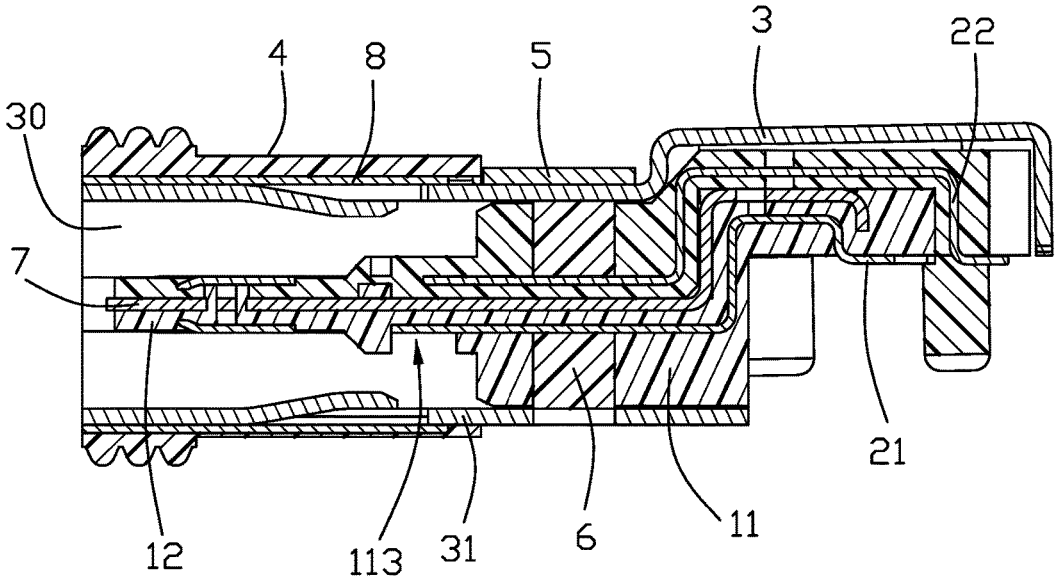
FIG. 13 is a cross-sectional view of the electrical connector along line 13-13 shown in FIG. 1.
Figure 14:
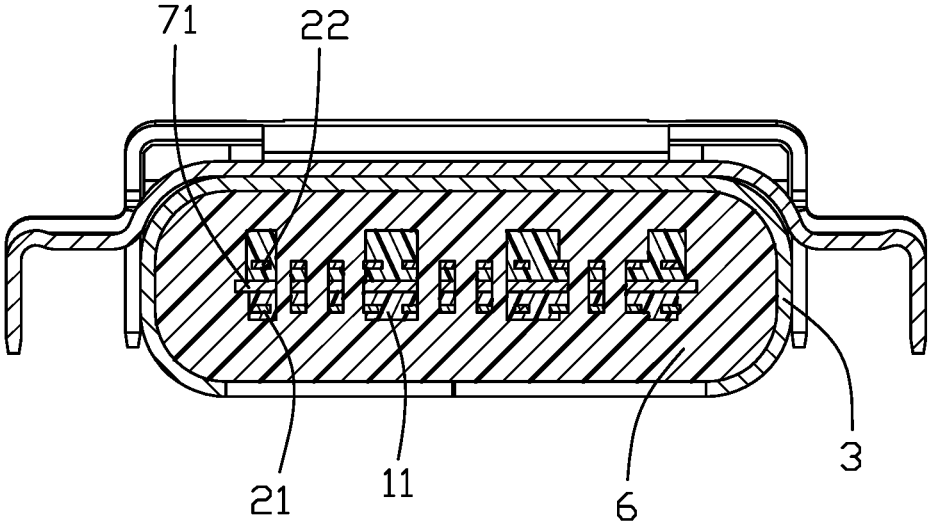
FIG. 14 is a cross-sectional view of the electrical connector along line 14-14 shown in FIG. 1.

Referring to FIG. 3, the insulative housing 1 defines an accommodating room (not labeled), the waterproof material is injected into the accommodating room from the opening hole 50 to form the waterproof member 6. Referring to FIGS. 13-14, the waterproof member 6 is disposed between the insulative housing 1 and the shielding shell 20. The waterproof member 6 is formed around the conductive terminals 2 and the shielding plate 7. The accommodating room has a first room 111 to which the conductive terminals 2 exposed and a second room 112 configured as annular. The waterproof member 6 is formed in the first room 111 and the second room 112.

Referring to FIGS. 1-2, 9-13, the shielding shell 10 has a metallic shell 3, a waterproof shell 4 embedded therearound, a sealing member 8 disposed between the metallic shell 3 and the waterproof shell 4 and a retaining member 5 disposed at a rear side of the waterproof member 4.

In the present preferred embodiment, the metallic shell 3 is formed by stamping a metal plate (Other embodiments don't have the limitation). The metallic shell 3 surrounds the insulative housing 1 to form the mating cavity 30. The metallic shell 3 has a surrounding portion 31 surrounding the mating portion 12 and a rear cover 32 covering the base portion 11. The surrounding portion 31 has a seam 33 filled with a soldering portion 9. The soldering portion 9 is formed by laser welding technology. The surrounding portion 31 doesn't define mounting legs. The rear cover 32 defines mounting legs 321. The surrounding portion 31 has at least one resilient pressing portion 311 extending into the mating cavity 30 and at least one corresponding opening slot 312.

The sealing member 8 covers the opening slot 312 to prevent the waterproof material flowing into the opening slot 312 in the process of forming the waterproof shell 4. In the present preferred embodiment, the sealing member 8 entirely covers the opening slot 312 so as to entirely separate the opening slot 312 and the waterproof member 4. Certainly, in some other embodiments, some waterproof material is hard to flow through a small gap, some electrical connectors allow little waterproof material flow in, therefore the sealing member 8 may not entirely cover the opening slot 312. The sealing member 8 may be formed as a metal ring disposed around an outer surface of the metallic shell 3 or a thin plate attached to an outer side of the opening slot 312. The metal ring may be formed by MIM (Metal Injection Molding) technology or drawing technology. In the present preferred embodiment, the sealing member 8 doesn't define mounting legs. What's more, the sealing member 8 may define a convex hull (not shown) recessed outwardly and being corresponding to the resilient pressing member 311. The resilient pressing member 311 may move into a recess formed by the convex hull when the resilient pressing member 311 is forced by an external press.

Figure 10:
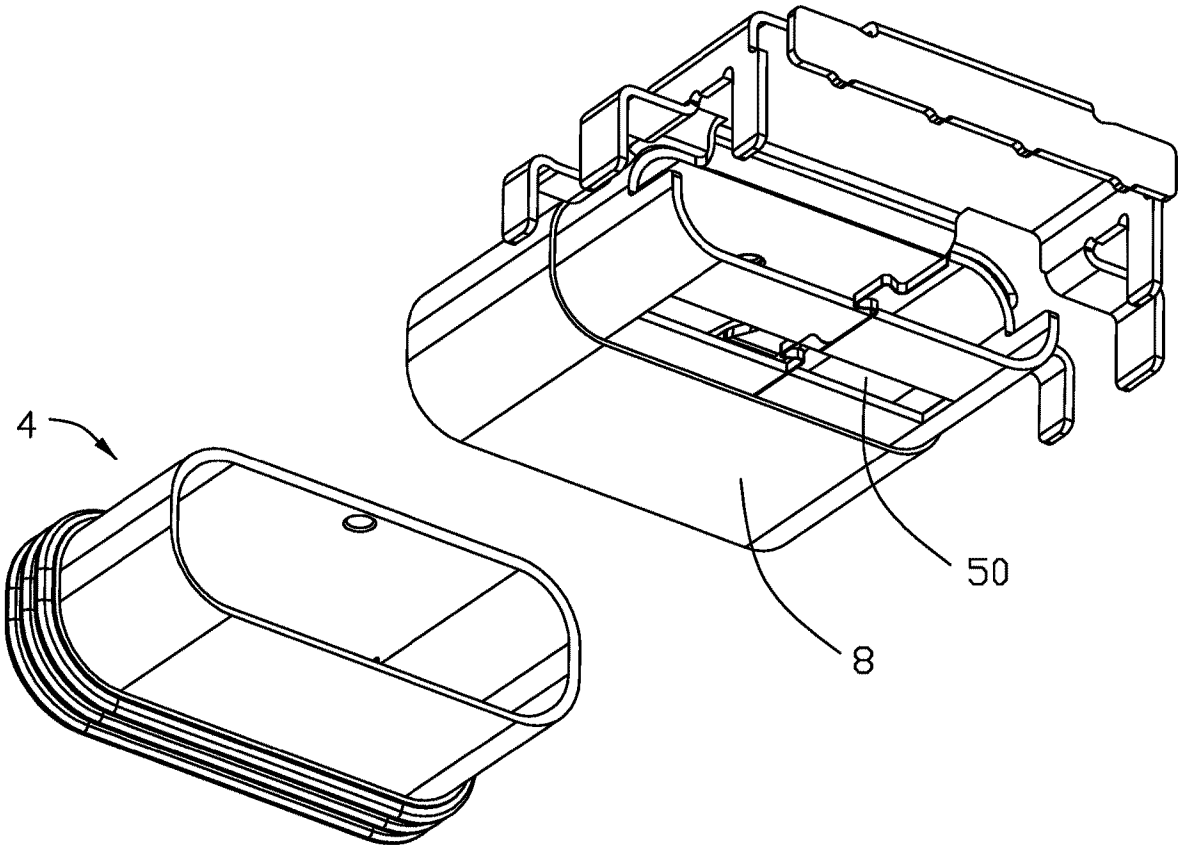
FIG. 10 is another perspective view of the shielding shell shown in FIG. 9.
Figure 11:
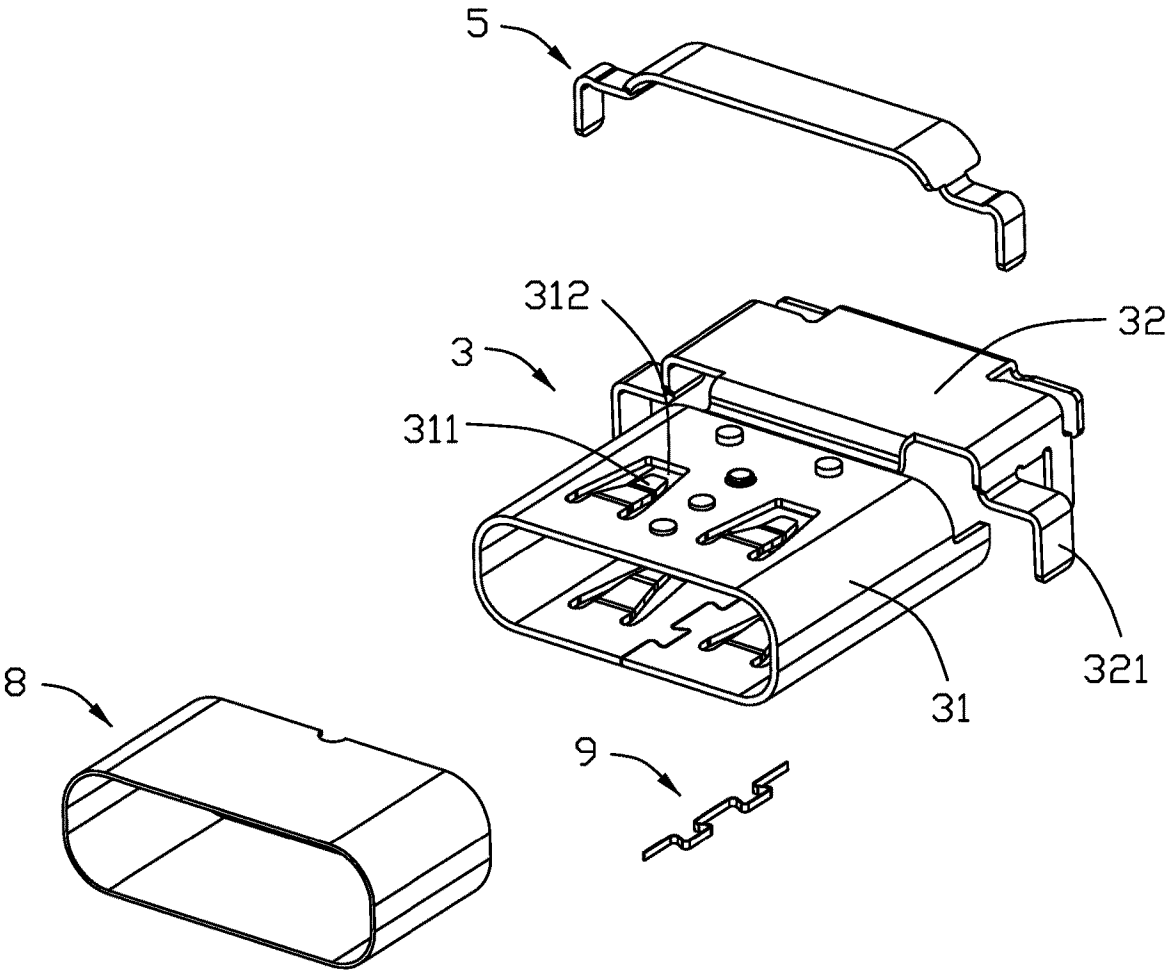
FIG. 11 is an exploded perspective view of the shielding shell shown in FIG. 4.
Figure 12:
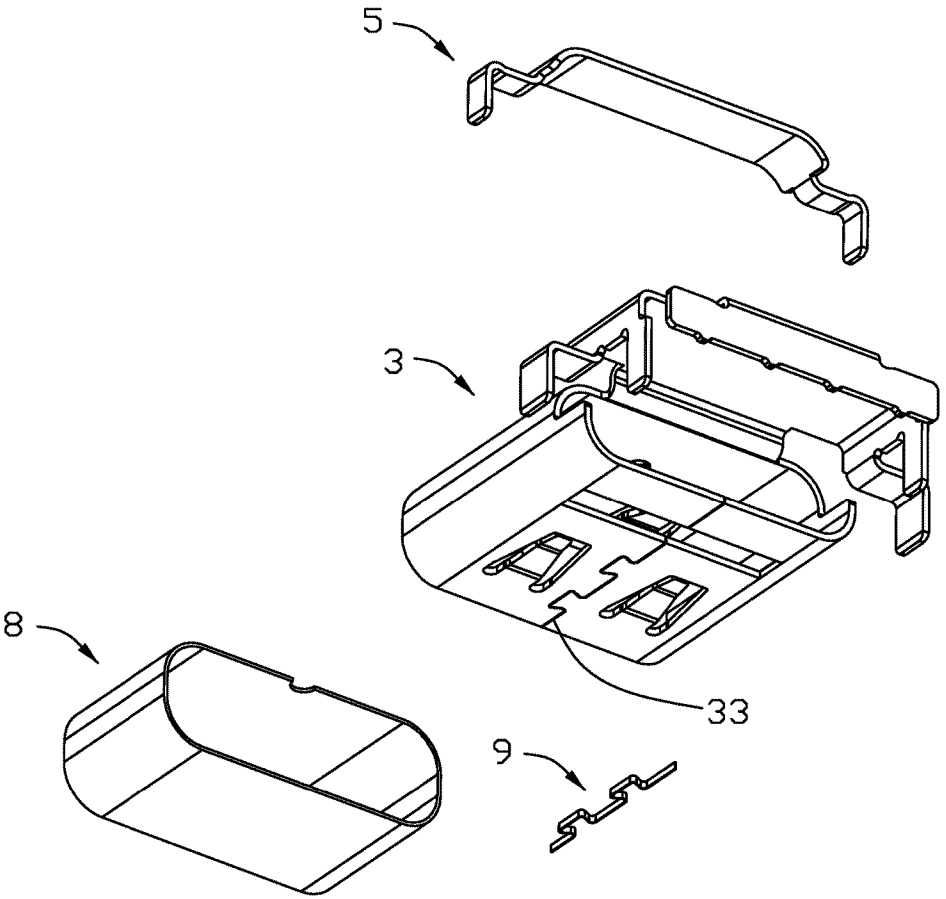
FIG. 12 is another perspective view of the shielding shell shown in FIG. 11.

The retaining member 5 and the sealing member 8 are separately disposed on the surrounding portion 31. The sealing member 8 is disposed in front of the retaining member 5. The retaining member 5 has two mounting legs 51. Referring to FIG. 10, the opening hole 50 is defined on a side of the surrounding portion 31 which is opposite to the retaining member 5. The waterproof shell 4 is made of insulative plastic or elastic material. When the waterproof shell 4 is made of elastic material, the waterproof shell 4 unitarily forms an interfering portion 41 protruding outwardly to interfere with the electronic device. When the waterproof shell 4 is made of insulative plastic, an elastic ring should be made to surround an outer surface of the waterproof shell 4 to function as the interfering portion 41. Referring mainly to FIG. 13, the waterproof shell 4 extends rearwardly beyond the sealing member 8 and surrounds an outer surface of the metallic shell 3 to prevent the liquid material which flows into a gap between the sealing member 8 and the metallic shell 3 from the opening slot 312.

Figure 4:
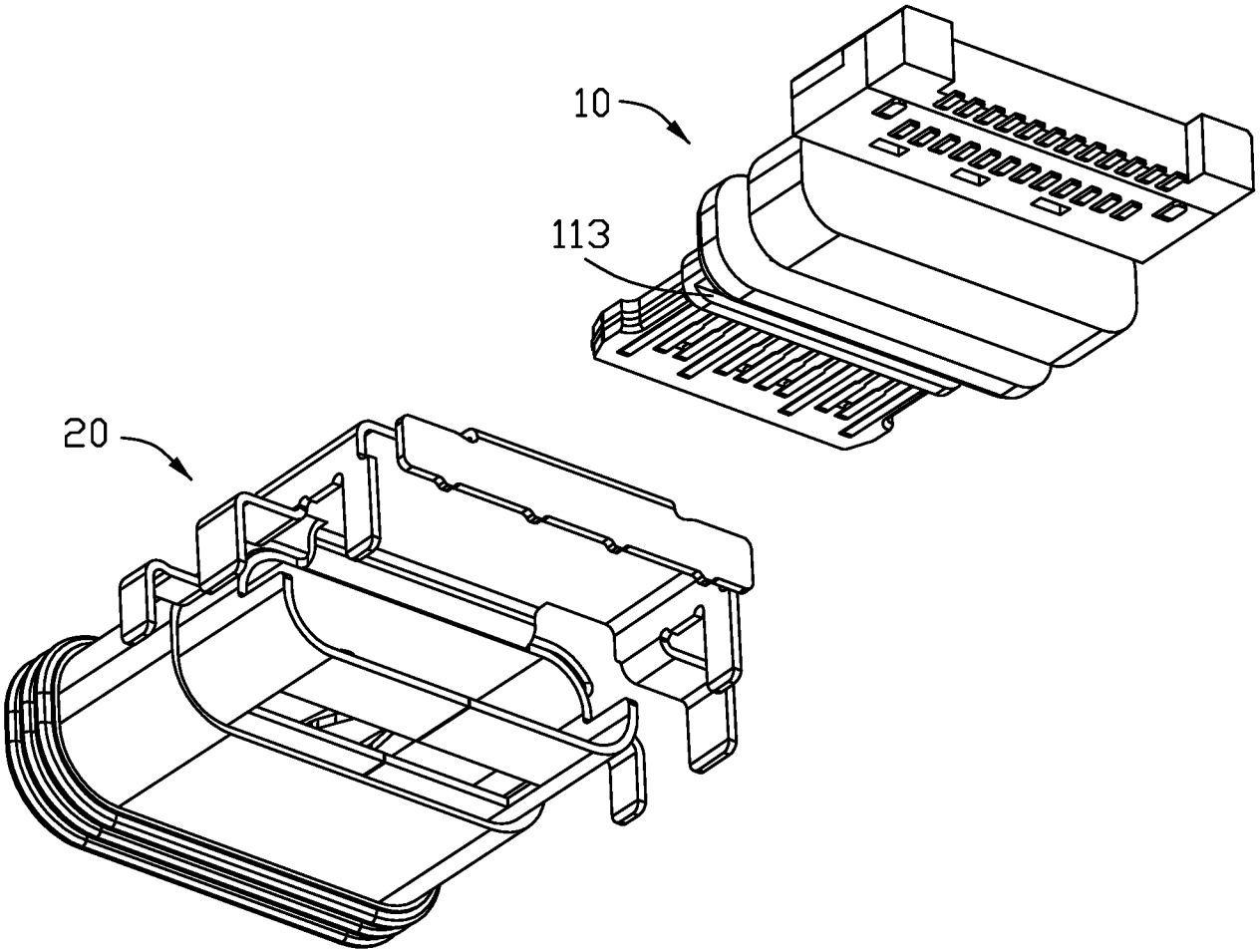
FIG. 4 is a part exploded perspective view of the electrical connector shown in FIG. 1, wherein the terminal module is not assembled into the shielding shell.
Figure 5:
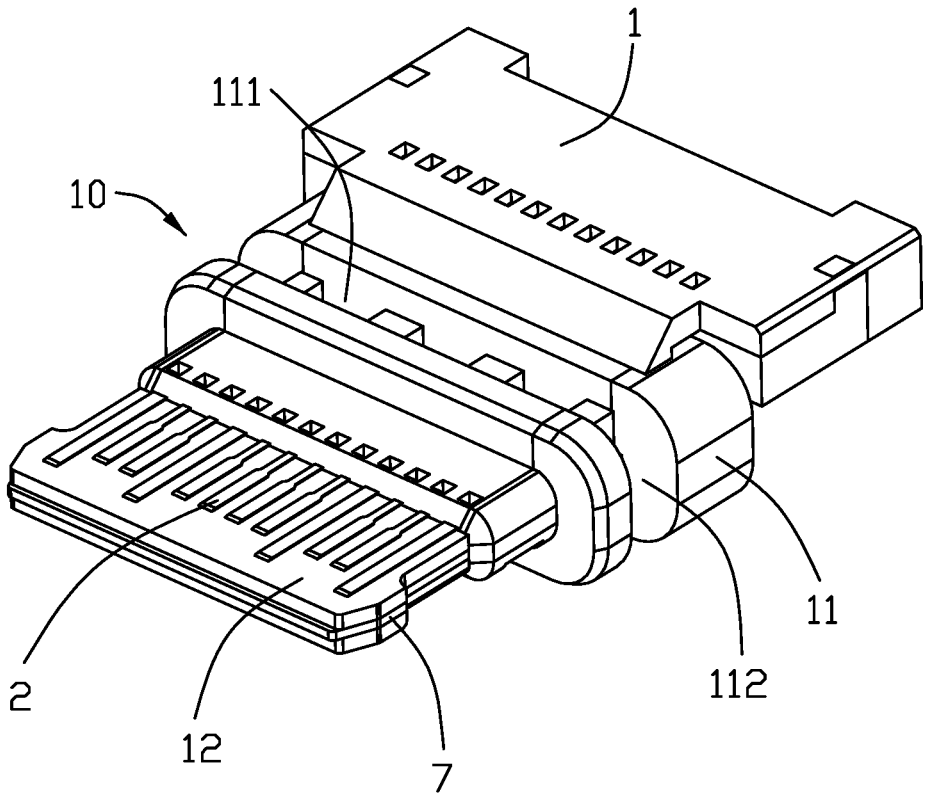
FIG. 5 is another perspective view of the terminal module shown in FIG. 4.
Figure 6:
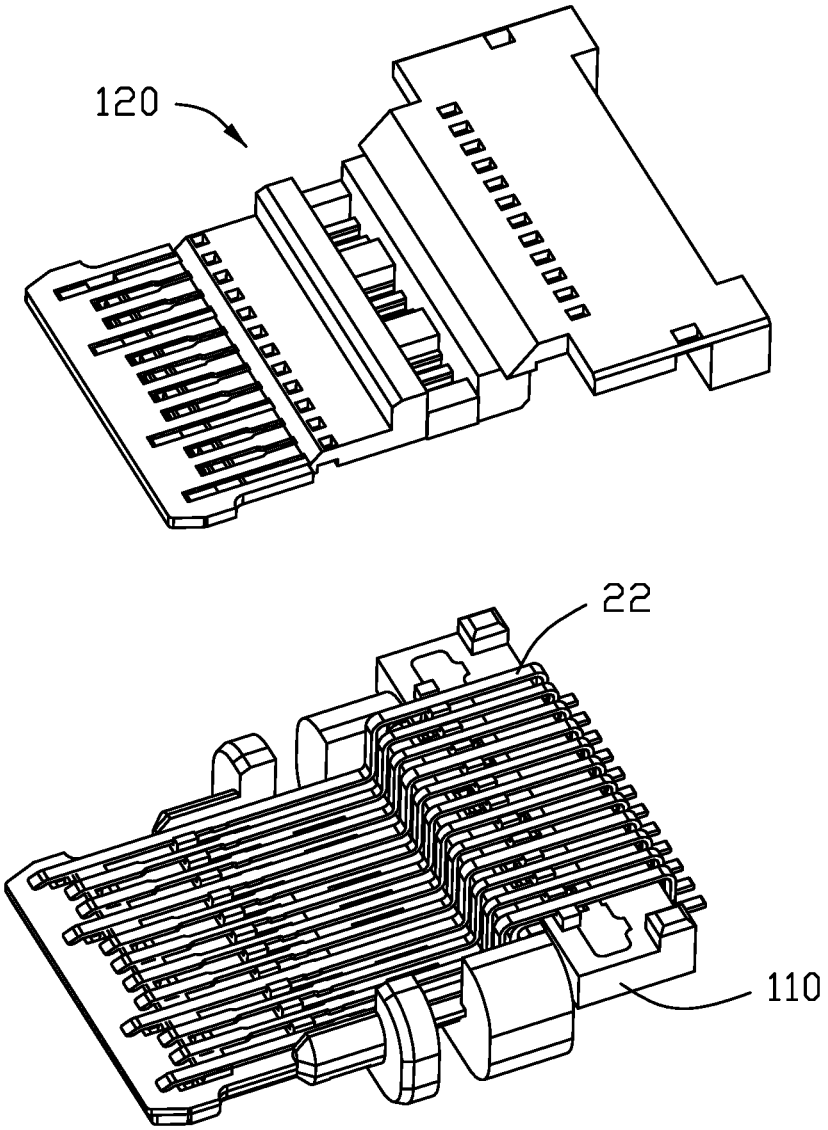
FIG. 6 is a part exploded perspective view of the terminal module shown in FIG. 5.
Figure 7:
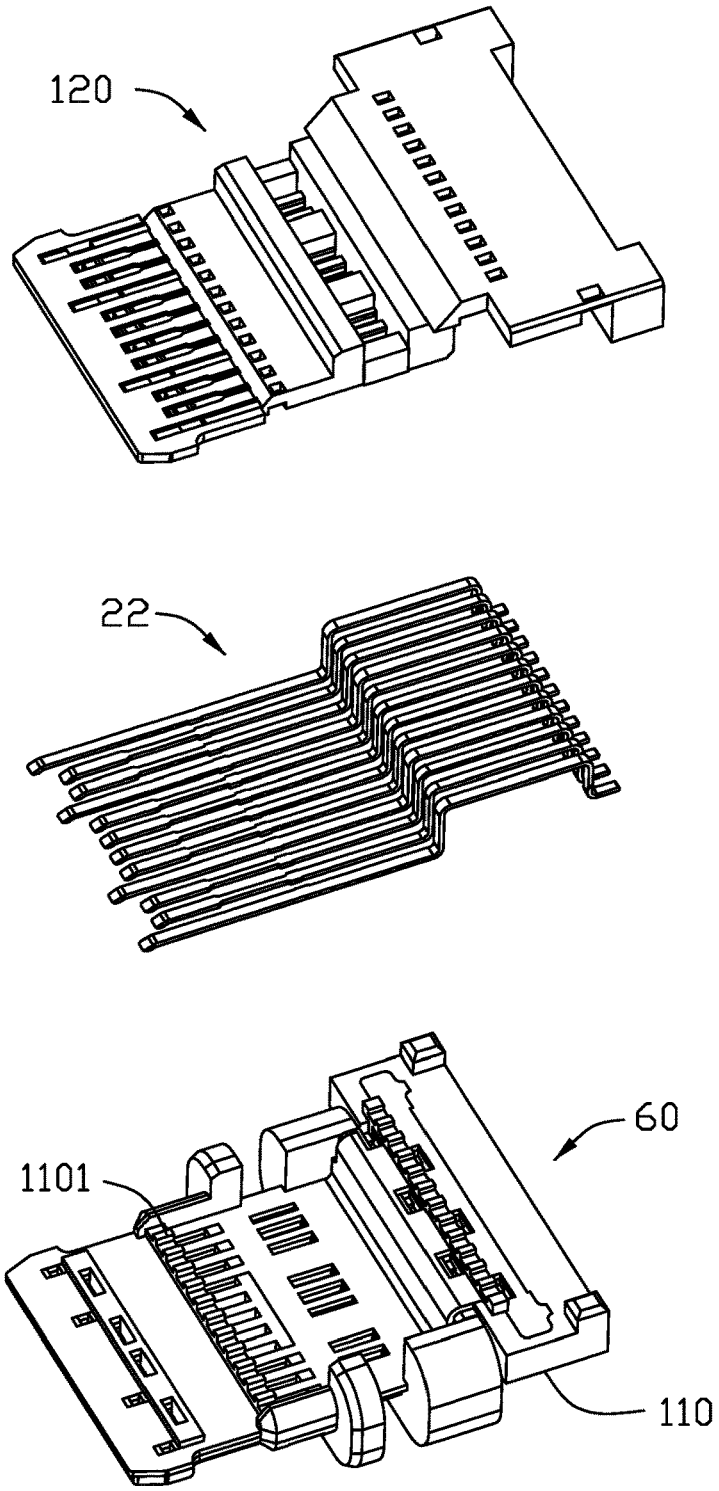
FIG. 7 is an exploded perspective view of the terminal module shown in FIG. 6.
Figure 8:
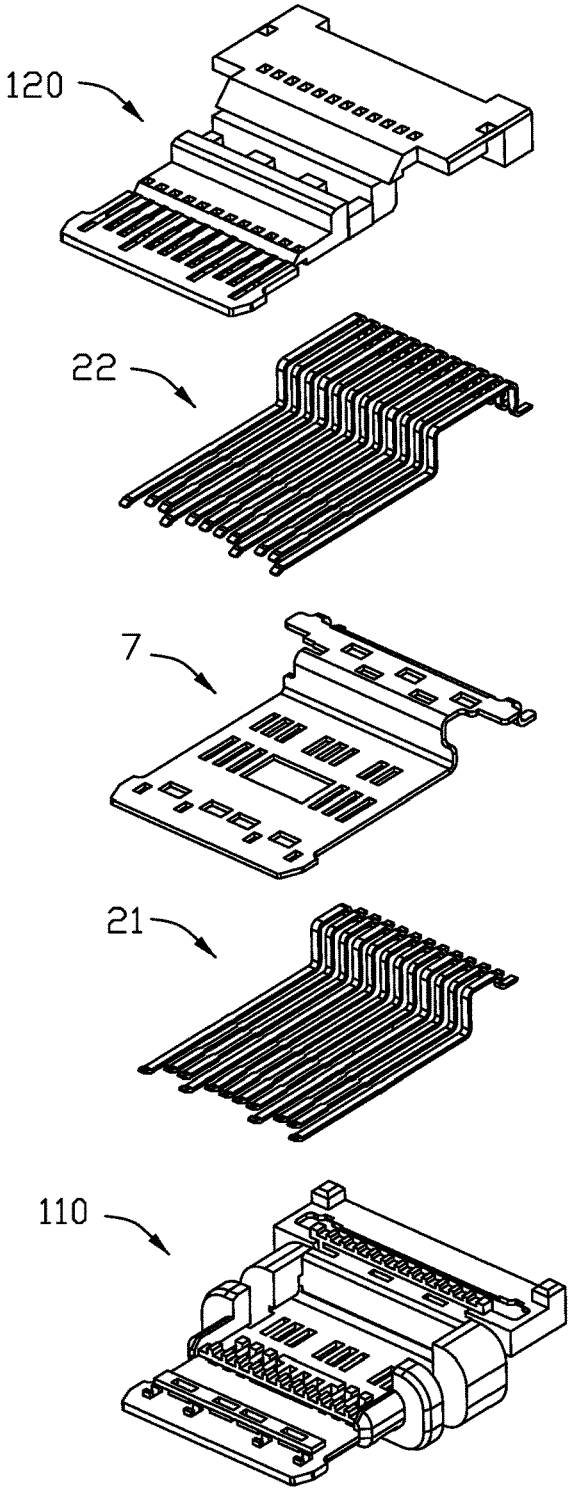
FIG. 8 is an exploded perspective view of the terminal module shown in FIG. 5.
Figure 9:
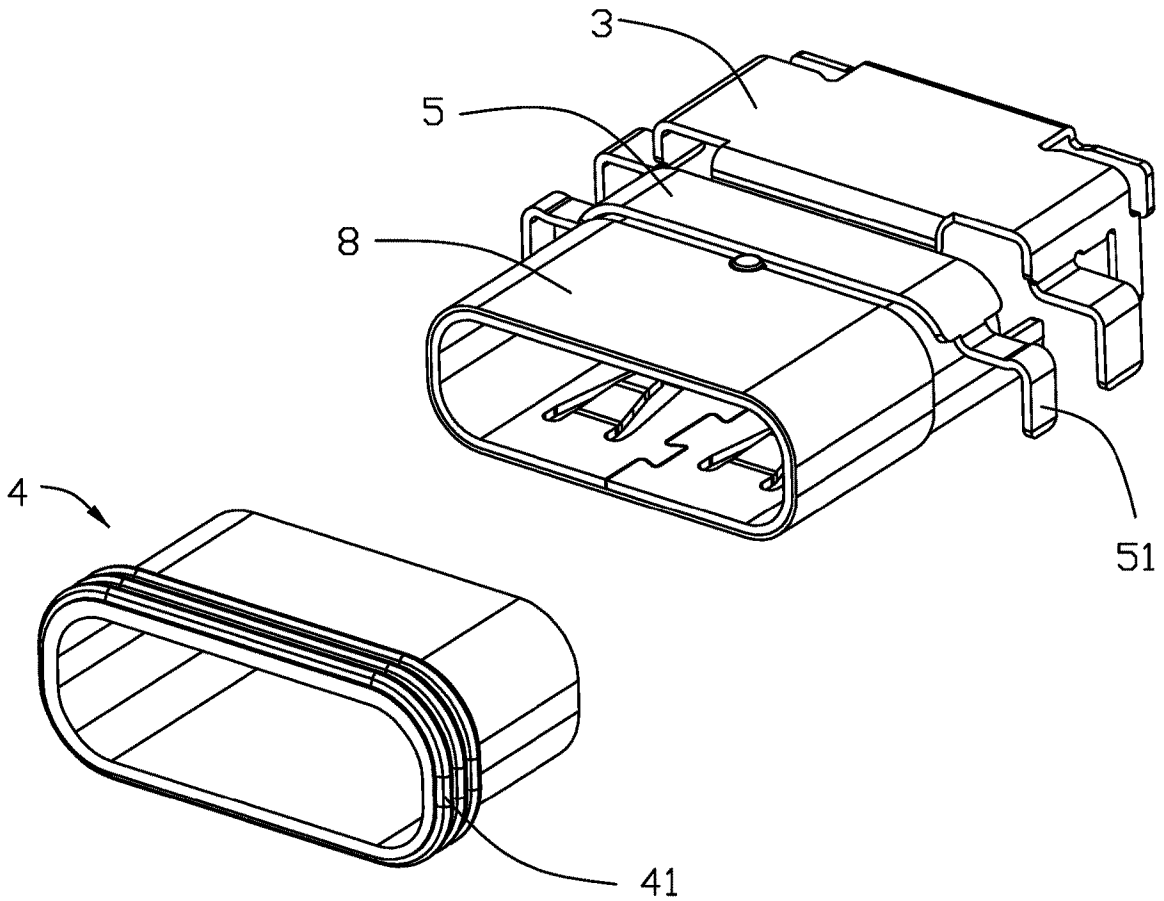
FIG. 9 is a part exploded perspective view of the shielding shell shown in FIG. 4.

Referring to FIG. 4, in the present preferred embodiment, the shielding shell 20 is initially formed, and then the terminal module 10 is assembled into the shielding shell 20 along a back-to-front direction. Certainly, in other embodiments, the terminal module 10 may be initially assembled into the metallic shell 3, and then forming the waterproof shell 4. In comparison, the way to form the shielding shell 20 in the present preferred embodiment is more easy and convenient. The waterproof shell 4 is formed after the retaining member 5 and the sealing member 8 being retained to the surrounding portion 31.

In conclusion, the sealing member 8 is disposed between the metallic shell 3 and the waterproof shell 4 to cover the opening slot 312. The retaining member 5 with two mounting legs 51 is disposed at a rear side of the waterproof shell 4. With the specific structure, the molding die used to form the waterproof shell 4 is more simple, the manufacturing process is more convenient.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

a terminal module having an insulative housing and a plurality of conductive terminals retained in the insulative housing; and a shielding shell surrounding the terminal module, the shielding shell having a metallic shell and a waterproof shell insert molded on an outer side of the metallic shell, the metallic shell surrounding the insulative housing to form a mating cavity opening forwardly;

wherein the shielding shell has a metallic sealing member disposed between the metallic shell and the waterproof shell and a retaining member disposed at a rear side of the waterproof shell, the retaining member is separate from the sealing member, the metallic shell defines an opening slot going therethrough, the sealing member covers the opening slot, and the retaining member defines a mounting leg; wherein the waterproof shell rearwardly extends beyond the whole opening slot in a front-to-back direction; wherein the insulative housing has a base portion and a mating portion extending forwardly from the base portion, the metallic shell has a surrounding portion surrounding around the mating portion, the sealing member and the retaining member are disposed on the surrounding portion, and the sealing member is located in front of the retaining member; and a waterproof member disposed at a rear side of the mating cavity, the surrounding portion has an opening hole opposite to the retaining member, and the opening hole is provided for waterproof material flowing therethrough.

2. The electrical connector as claimed in claim 1, wherein the metallic shell has a resilient pressing portion extending into the mating cavity, and the opening slot is formed corresponding to the resilient pressing portion.

3. The electrical connector as claimed in claim 1, wherein the waterproof shell is made of insulative plastic material or elastic material, and the waterproof shell unitarily forms an interfering portion protruding outwardly when the waterproof shell is made of elastic material.

4. The electrical connector as claimed in claim 1, wherein the sealing member entirely covers the opening slot to entirely separate the opening slot from the waterproof shell.

5. The electrical connector as claimed in claim 1, wherein the waterproof shell extends rearwardly beyond the sealing member and surrounds an outer surface of the metallic shell.

6. The electrical connector as claimed in claim 1, wherein the sealing member is manufactured as a metal ring surrounding around the metallic shell or a thin plate attached to an outer side of the opening slot.

7. An electrical connector comprising:

a terminal module including a plurality of conductive terminals disposed in an insulative housing;

a metallic shielding shell made from sheet metal with a tubular configuration to surround the terminal module and define a mating cavity therein, said shielding shell forming a seam essentially extending along a front-to-back direction, and an opening slot with a resilient pressing portion extending into the mating cavity;

a tubular seamless metallic sealing member intimately surrounding the shielding shell to fully cover both the seam and the opening slot;

an insulative waterproof shell applied upon the sealing member via a molding process to have said sealing member sandwiched between the waterproof shell and the shielding shell; and a metallic retaining member attach upon the shielding shell and behind the sealing member, wherein said retaining member, including at least one mounting leg;

wherein said shielding shell forms an opening hole communicating with an exterior in a vertical direction; and wherein a sealing member is formed in the housing surrounding the corresponding conductive terminals by injecting due through said opening hole.

8. The electrical connector as claimed in claim 7, wherein said housing includes a base portion and a tongue portion extending forwardly from the base portion, and a rear end of the waterproof shell is terminated at a vertical plane, which is perpendicular to said front-to-back direction, where an interface between the tongue portion and a base portion is located.

9. The electrical connector as claimed in claim 8, wherein a rear region of said tongue portion forms a slot extending in a transverse direction perpendicular to both said front-to-back direction and said vertical direction, to expose the corresponding conductive terminals in the vertical direction.

10. The electrical connector as claimed in claim 7, wherein said sealing member is essentially located under the retaining member in a vertical direction perpendicular to said front-to-back direction.

11. The electrical connector as claimed in claim 7, wherein said waterproof shell extends rearwardly beyond the opening slot in the front-to-back direction.

* * * * *